US010383383B2

(12) United States Patent
Okada

(10) Patent No.: US 10,383,383 B2
(45) Date of Patent: Aug. 20, 2019

(54) CLOTH MEMBER FASTENER

(71) Applicant: Okada Kaiteki Ltd., Matsuyama-shi, Ehime (JP)

(72) Inventor: Shiro Okada, Matsuyama (JP)

(73) Assignee: Okada Kaiteki Ltd., Matsuyama-shi, Ehime (JP)

( * ) Notice: Subject to any disclaimer, the term of this patent is extended or adjusted under 35 U.S.C. 154(b) by 72 days.

(21) Appl. No.: 15/846,250

(22) Filed: Dec. 19, 2017

(65) Prior Publication Data

US 2018/0103705 A1 Apr. 19, 2018

Related U.S. Application Data

(63) Continuation-in-part of application No. PCT/JP2016/068462, filed on Jun. 22, 2016.

(30) Foreign Application Priority Data

Aug. 26, 2015 (JP) ..... 2015-166349

(51) Int. Cl.
*A41F 11/04* (2006.01)
*A41F 11/06* (2006.01)

(52) U.S. Cl.
CPC ..... *A41F 11/04* (2013.01); *A41F 11/06* (2013.01); *Y10T 24/44197* (2015.01)

(58) Field of Classification Search
CPC .... A41F 11/04; A41F 11/06; Y10T 24/44197; Y10T 24/4077; Y10T 24/44137; Y10T 24/44214; Y10T 24/45806
See application file for complete search history.

(56) References Cited

U.S. PATENT DOCUMENTS 800,780 A * 10/1905 Wyrtzen ..... A41F 11/04 24/469
1,030,098 A * 6/1912 Lemay ..... A41F 11/04 24/480

(Continued)

FOREIGN PATENT DOCUMENTS

JP 2003-193315 A 7/2003
JP 2003-227003 A 8/2003

*Primary Examiner* — Robert Sandy
*Assistant Examiner* — Rowland Do
(74) *Attorney, Agent, or Firm* — JTT Patent Services, LLC; Gerald T. Peters

(57) ABSTRACT

Cloth member fastener (1) may comprise tongue(s) (30) having engagement projection(s) (32) comprising head portion(s) (33) and neck portion(s) (34); loop frame(s) (10) comprising capturing hole(s) (13) for capturing engagement projection(s) (32) and made up of narrow capturing hole region(s) (13*b*) through which only neck portion(s) (34) can pass, and wide insertion hole region(s) (13*a*) through which head portion(s) (33) and neck portion(s) (34) can pass; stopper hinge shaft(s) (22) extending in horizontal direction(s) and disposed toward base end(s); and hinging stopper(s) (20) coupled in hinged fashion by means of hinge structure(s) with respect to loop frame(s) (10) due to the fact that stopper hinge shaft(s) (22) is/are wrapped about between pair(s) of hinge holes (15*a*, 15*b*) of loop frame(s) (10) by bent portion(s) (39) of tongue(s) (30). When closed, hinging stopper(s) (20) may cover wide insertion hole region(s) (13*a*) and inhibit movement of engagement projection(s) (32).

11 Claims, 7 Drawing Sheets

(56) References Cited

U.S. PATENT DOCUMENTS

| | | | | | |
|---|---|---|---|---|---|
| 1,509,461 | A * | 9/1924 | Aebi | A41F 11/04 | 24/496 |
| 1,964,938 | A * | 7/1934 | Dupont | A41F 11/04 | 24/471 |
| 2,023,729 | A * | 12/1935 | Forkey | A41F 11/12 | 24/478 |
| 2,723,435 | A * | 11/1955 | Batzdorff | A41F 11/04 | 24/478 |
| 2,732,604 | A * | 1/1956 | Keltie | A41F 11/04 | 24/193 |
| 2,870,505 | A * | 1/1959 | Hawie | A41F 11/04 | 24/193 |
| 3,338,244 | A * | 8/1967 | Burke | A41B 11/12 | 2/306 |
| 3,406,434 | A * | 10/1968 | Moskowitz | A41F 11/04 | 24/490 |
| 3,408,708 | A * | 11/1968 | Hawie | A41F 11/04 | 24/199 |
| 5,353,441 | A * | 10/1994 | Lazorchak | A41D 27/085 | 2/240 |
| 2010/0162467 | A1* | 7/2010 | Rondon | A41F 11/18 | 2/227 |

* cited by examiner

CLOTH MEMBER FASTENER

CROSS-REFERENCE TO RELATED APPLICATION, PRIORITY CLAIMS, AND INCORPORATION BY REFERENCE

This application is a continuation-in-part of and claims benefit under 35 USC 120 and 365(c) to copending International Application No PCT/JP2016/068462, entitled "Cloth Member Fastener", filed 22 Jun. 2016; and further claims benefit of priority under 35 USC 119(a)-(d) to Japanese Patent Application No 2015-166349, entitled "Cloth Member Fastener", filed 26 Aug. 2015, the contents of both of which applications are incorporated herein in their entireties by reference.

FIELD OF THE INVENTION

The present invention relates to a cloth member fastener for clamping to and fastening edge(s) of long sock(s) or other such cloth member(s) worn on the leg(s).

BACKGROUND

To prevent garter stockings and other such long socks worn on the legs from slipping down, garter belts and other such long sock suspenders that suspend and lift long socks by clamping to edges of openings at top ends thereof may be employed.

For example, in one type of long sock suspender, a garter clip or other such capturing fixture may be employed as long sock fastener for clamping to and fastening the top end of a long sock.

Where a long sock fastener that suspends and lifts a long sock by merely clamping and fastening a top end of a long sock by means of a tongue and a loop frame between which the top end of the long sock is captured is employed, if this should come free therefrom so as to no longer be captured by the loop frame and the tongue, this may cause the fastener to become completely detached therefrom, making it difficult to carry out suspending and lifting in stable fashion.

There is therefore a need for a cloth member fastener capable of causing an edge of a cloth member to be fastened in stable fashion.

SUMMARY OF INVENTION

One embodiment of the present invention is a cloth member fastener for clamping and holding an edge of a cloth member. One example of such a cloth member is a long sock that might, for example, be worn on a leg.

In one embodiment, the cloth member fastener comprises a tongue, a loop frame, and a hinging stopper.

The tongue, the loop frame, and the hinging stopper may be mutually coupled in hinged fashion by means of a common hinge structure.

The common hinge structure may comprise a hinge shaft of the loop frame.

The common hinge structure may further comprise a hinge shaft of the hinging stopper.

The common hinge structure may further comprise a hinge portion of the tongue that at least partially surrounds and captures therewithin the hinge shaft of the loop frame and the hinge shaft of the hinging stopper.

In one embodiment, the tongue hinge portion of the tongue is formed as a result of the fact that an end of the tongue is bent back upon itself.

The tongue may comprise an engagement projection which is captured by the loop frame and which has a head portion and a neck portion.

The tongue may further comprise a bent portion which is a part that is bent back upon itself toward a base end of the tongue.

The tongue may further comprise a back catch which is formed at an end portion at the base end of the tongue.

In one embodiment, the loop frame comprises a capturing hole for capturing the engagement projection when the engagement projection is inserted therein.

Where present, the capturing hole of the loop frame may comprise a narrow capturing hole region and a wide insertion hole region.

The narrow capturing hole region may be disposed at a location toward the tip end of the loop frame. The narrow capturing hole region may be such that only the neck portion can pass therethrough.

Where present, the wide insertion hole region may be disposed at a location toward the base end of the loop frame. The wide insertion hole region may be such that the head portion and the neck portion can pass therethrough.

Where present, the narrow capturing hole region and the wide insertion hole region may be formed so as to be joined in continuous fashion in a long direction perpendicular to a tongue hinge shaft at the hinge structure.

The loop frame may further comprise two hinge holes. The two hinge holes may be formed at a base portion of the loop frame.

Where present, the two hinge holes of the loop frame may cause the tongue to be coupled in hinged fashion with respect to the loop frame by virtue of the fact that the bent portion of the tongue is made to pass through the two hinge holes of the loop frame in continuous fashion.

In one embodiment, the hinge shaft of the hinging stopper extends in a horizontal direction. In such an embodiment, the hinge shaft of the hinging stopper may be disposed toward the base end of the hinging stopper.

In one embodiment, the hinging stopper is coupled in hinged fashion by means of the hinge structure with respect to the loop frame as a result of the fact that the stopper hinge shaft is wrapped about between the two hinge holes of the loop frame by the bent portion of the tongue.

In one embodiment, the hinging stopper is constituted so as to cover the wide insertion hole region of the capturing hole when the hinging stopper is in a closed state with respect to the loop frame.

In one embodiment, the hinging stopper is constituted such that, when the hinging stopper is closed with respect to the loop frame, the hinging stopper inhibits the engagement projection of the tongue so as to prevent the engagement projection of the tongue, when the engagement projection of the tongue is captured by the loop frame at the narrow capturing hole region, from moving toward the wide insertion hole region.

The hinging stopper may further comprise a hinge hole. Where present, the hinge hole of the hinging stopper may extend in the horizontal direction. The hinge portion of the tongue may be inserted through the hinge hole of the hinging stopper.

In one embodiment, the hinge hole of the hinging stopper is a closed figure that is not open to the exterior.

In another embodiment, the hinge hole of the hinging stopper is an open figure. In an embodiment in which the hinge hole of the hinging stopper is an open figure, an opening to the exterior may be formed at a side portion of the hinge hole of the hinging stopper.

In one embodiment, formed at either side face of the hinging stopper there may be fingernail recesses which can be grasped by fingernails when the hinging stopper is to be opened from its closed state.

In one embodiment, the cloth member fastener further comprises a capturing mechanism for capturing and securing the hinging stopper in a closed state with respect to the loop frame.

The capturing mechanism may be constituted such that, when the hinging stopper is in its closed state, a tip of the hinging stopper abuts a base end side face of the engagement projection of the tongue as the tip of the hinging stopper pushes said engagement projection toward the tip end when the engagement projection of the tongue is disposed at the narrow capturing hole region of the loop frame.

Alternatively or additionally, the capturing mechanism may comprise a stopper protrusion and a capturing notch. Where present, the stopper protrusion may be provided at the tip of the hinging stopper. Where present, the capturing notch may be provided at a base end side face of the engagement projection of the tongue. Where present, the capturing notch may mate with the stopper protrusion.

Cloth member fasteners in accordance with one or more embodiments of the present invention may make it possible, by closing a hinging stopper, to inhibit a tongue from becoming detached from a loop frame, making it possible to cause an edge of a cloth member to be fastened in stable fashion.

Other embodiments, systems, methods, and features, and advantages of the present invention will be or become apparent to one with skill in the art upon examination of the following drawings and detailed description. It is intended that all such additional systems, methods, features, and advantages be included within this description, be within the scope of the present invention, and be protected by the accompanying claims.

BRIEF DESCRIPTION OF DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION

Below, embodiments of the present invention are described with reference to the drawings.

In the description which follows, an embodiment of the present invention is described in terms of the example of a cloth member fastener in the form of a garter clip that, to prevent a garter stocking worn on a leg from slipping down, fastens to an edge of an opening at a top end of the garter stocking.

Figure 1:
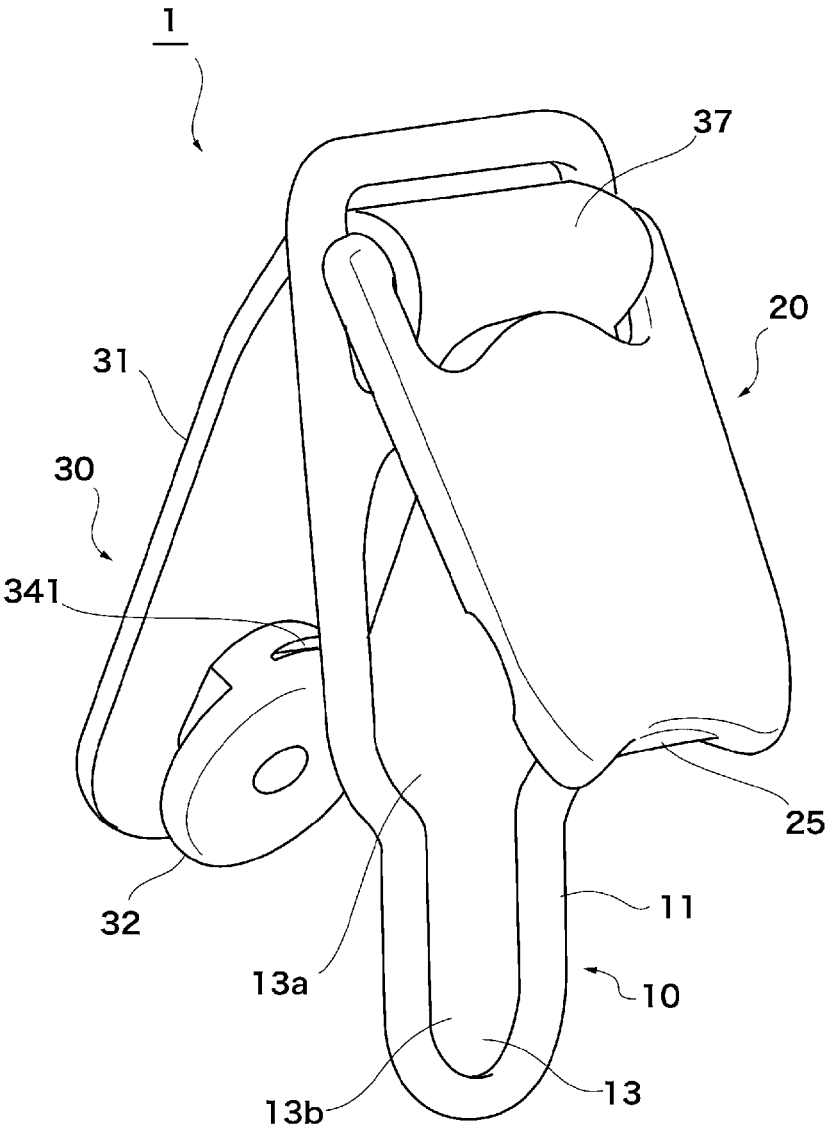
FIG. 1 is a perspective view of a garter clip associated with an embodiment of the present invention.
Figure 2:
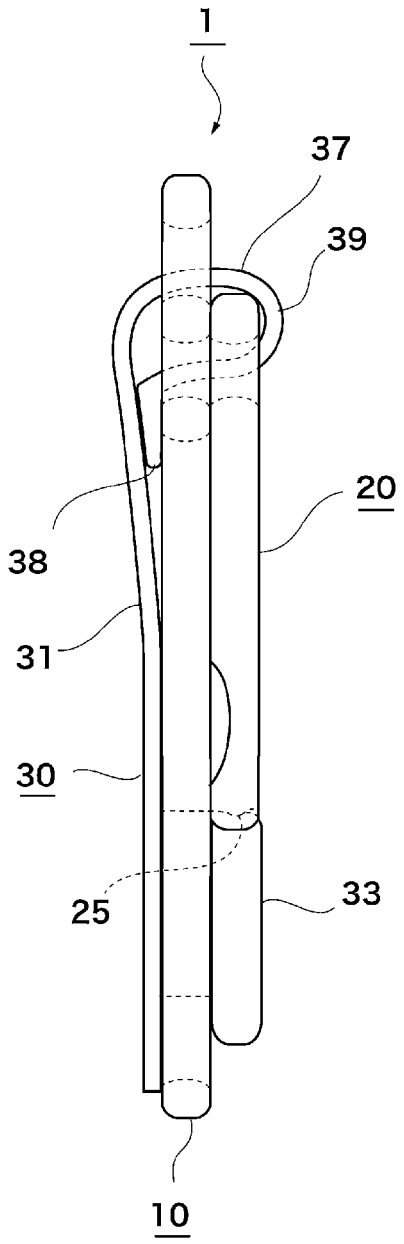
FIG. 2 is a side view of the garter clip shown in FIG. 1.

Referring to FIGS. 1 and 2, these show a garter clip 1 associated with an embodiment of the present invention. FIG. 1 is a perspective view of garter clip 1, garter clip 1 being shown in its open state at FIG. 1. FIG. 2 is a side view of garter clip 1 shown in FIG. 1, garter clip 1 being shown in its closed state at FIG. 2.

Figure 3:
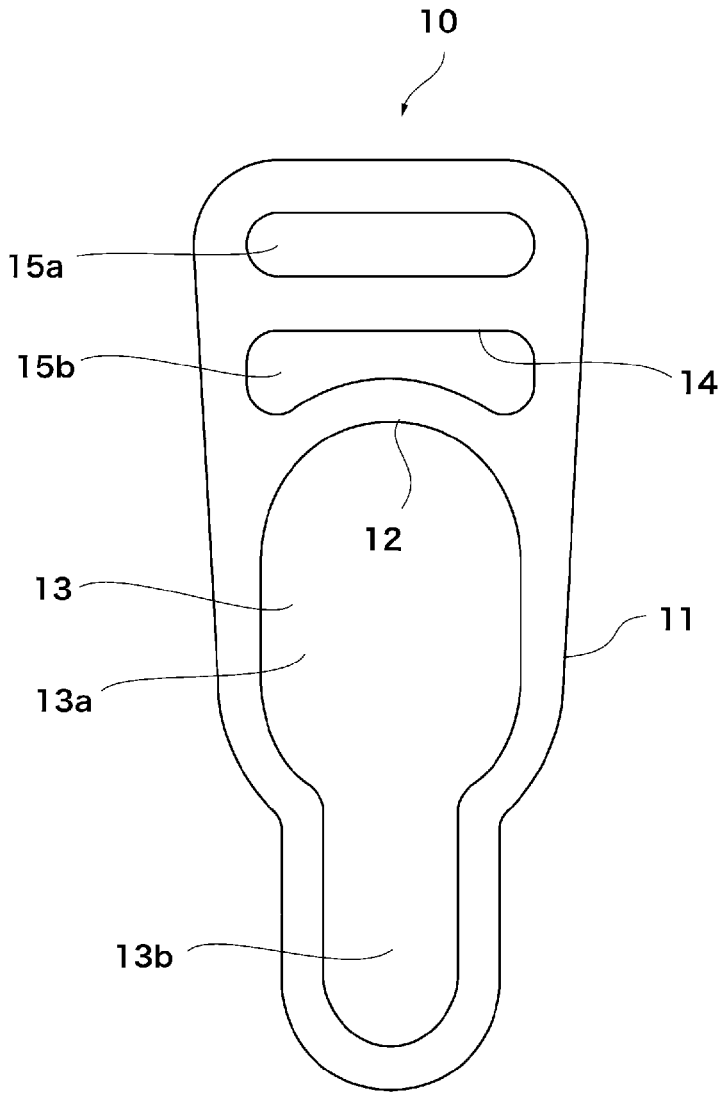
FIG. 3 is a front view of a loop frame associated with the embodiment shown in FIG. 1.

Referring to FIG. 3, this is a front view of a loop frame 10 associated with the embodiment shown in FIGS. 1 and 2.

Figure 4:
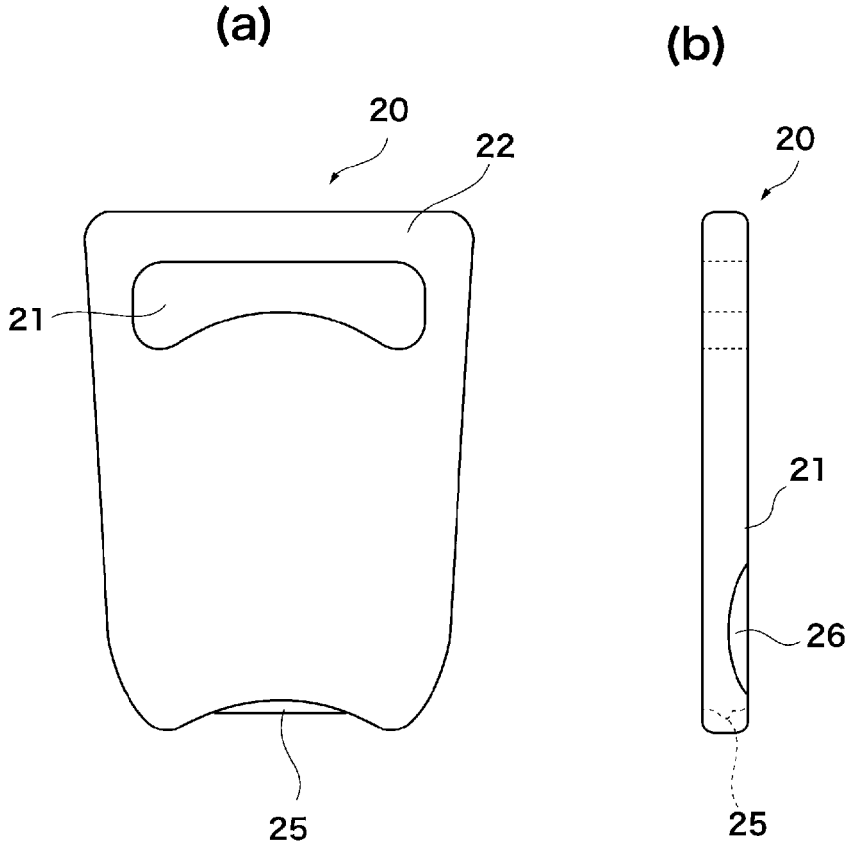
FIG. 4 is a drawing showing a hinging stopper associated with the embodiment shown in FIG. 1.

Referring to FIG. 4, this shows a hinging stopper 20 associated with the embodiment shown in FIGS. 1 and 2, (a) being a front view thereof, and (b) being a side view thereof.

Figure 5:
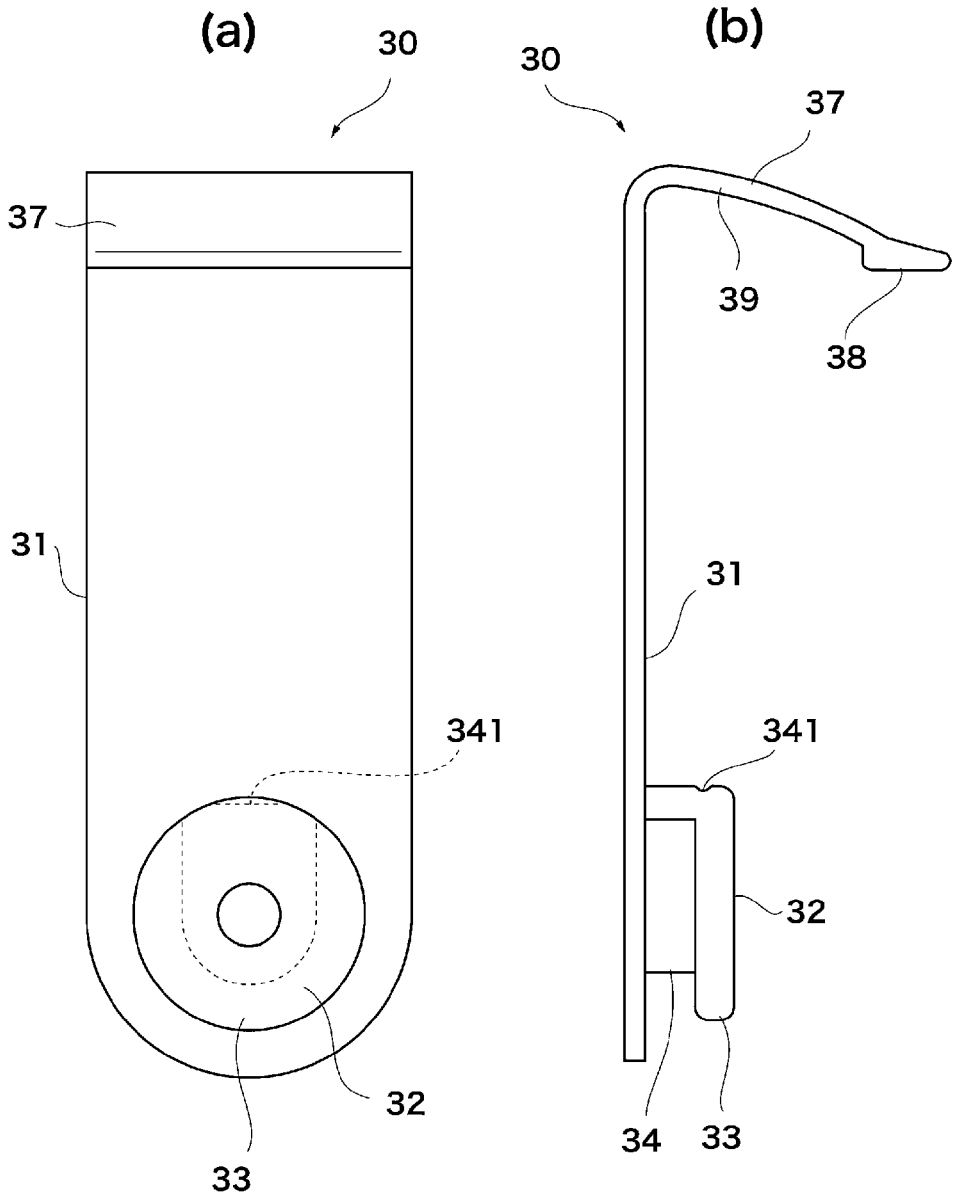
FIG. 5 is a drawing showing a tongue associated with the embodiment shown in FIG. 1.

Referring to FIG. 5, this shows a tongue 30 associated with the embodiment shown in FIGS. 1 and 2, (a) being a front view thereof, and (b) being a side view thereof.

Figure 6:
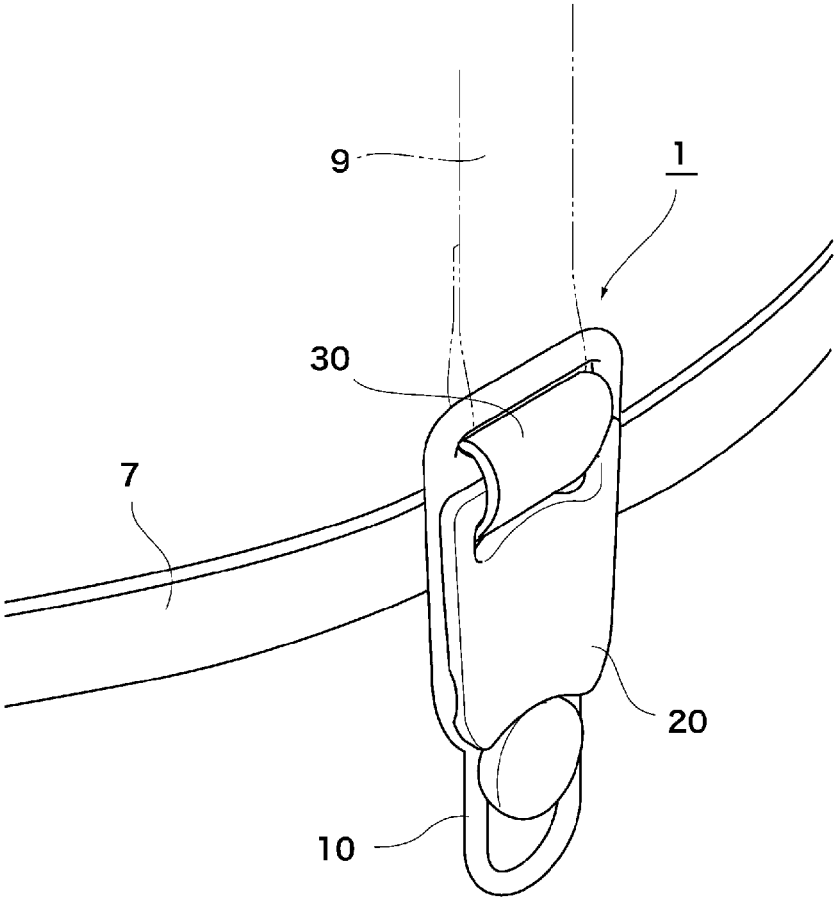
FIG. 6 is a drawing showing a mode of use of the garter clip shown in FIG. 1.

Referring to FIG. 6, this shows one possible mode of use of garter clip 1 shown in FIGS. 1 and 2.

Garter clip 1 in the embodiment shown in FIGS. 1 and 2 comprises loop frame 10; hinging stopper 20 which is coupled by a hinge structure to loop frame 10; and tongue 30 which is likewise coupled by a hinge structure to loop frame 10.

In the embodiment shown in FIGS. 1 and 2, loop frame 10, hinging stopper 20, and tongue 30 are mutually coupled in hinged fashion by means of a common hinge structure.

In the embodiment shown in FIGS. 1 and 2, garter clip 1 may be capable of being opened and closed between a state in which loop frame 10, hinging stopper 20, and tongue 30 mutually overlap in closed fashion and a state in which loop frame 10 is centrally disposed such that hinging stopper 20 and tongue 30 open in opposite directions at respectively prescribed angles with respect to loop frame 10.

Furthermore, in the embodiment shown in FIGS. 1 and 2, hinging stopper 20 and tongue 30 may respectively be capable of being opened and closed in independent fashion with respect to loop frame 10.

In the description that follows, the hinge axis about which hinging stopper 20 opens and closes is referred to as the stopper hinge axis, and the hinge axis about which tongue 30 opens and closes is referred to as the tongue hinge axis.

In the embodiment shown in FIGS. 1 and 2, the stopper hinge axis and the tongue hinge axis are mutually parallel and are disposed at mutually proximate locations.

In the context of the present embodiment, the long direction of loop frame 10, i.e., the vertical direction of the drawing of FIG. 3, is taken to be the vertical direction. Furthermore, in the context of the present embodiment, the axes of stopper hinge 22 and the tongue hinge portion 37 extend in what is referred to as the horizontal direction. Furthermore, in the context of the present embodiment, along the vertical direction, the end at which the axes of the hinges are disposed is taken to be the base end, and the end which is opposite the base end is taken to be the tip end.

In the embodiment shown in FIGS. 1 and 2, loop frame 10 comprises loop periphery 11, lateral slat 12, and hinge shaft 14. Formed at the interior of loop periphery 11 is capturing hole 13 for capturing engagement projection 32 of tongue 30, described below, which is enclosed by loop periphery 11 and lateral slat 12. Capturing hole 13 comprises wide insertion hole region **13*a* which is disposed toward the base end and narrow capturing hole region 13*b* which is disposed toward the tip end, the two being joined in continuous fashion so as to constitute a single hole (capturing hole 13**).

By "toward the base end" or "toward the tip end", it is respectively meant that the feature in question is closer to the base end than it is to the tip end, or that the feature is closer to the tip end than it is to the base end.

Hinge shaft 14 is a rod-shaped member provided in integral fashion in the horizontal direction with respect to loop periphery 11 at a location toward the base end from lateral slat 12. The two holes enclosed by lateral slat 12, hinge shaft 14, and the base portion of loop periphery 11 function as hinge holes 15, through which hinge portion 37 of tongue 30, described below, is inserted so as to permit engagement with loop frame 10. Note that loop periphery 11, lateral slat 12, and/or hinge shaft 14 may be made of metal, may be formed in integral fashion, and may have surfaces that are coated with synthetic resin.

Hinging stopper 20, which is a stopper that may be made of synthetic resin and that when closed with respect to loop frame 10 may inhibit tongue 30 so as to prevent tongue 30 from being opened, is coupled in hinged fashion by a hinge structure to the base portion of loop frame 10 by means of bent portion 39 of tongue 30, described below. Hinging stopper 20 of the present embodiment is a more or less rectangular plate, formed at the base portion of which is hinge hole 21, hinge hole 21 being an elongated hole extending in the horizontal direction through which hinge portion 37 of tongue 30, described below, is inserted.

When hinge portion 37 of tongue 30 is inserted through hinge hole 21, the portion extending in the horizontal direction that is disposed toward the base end of hinge hole 21 and that is enclosed by hinge portion 37 functions as hinge shaft 22 in such fashion that hinging stopper 20 is made openable/closable with respect to loop frame 10.

Here, the size of hinging stopper 20 is such that the width thereof in the horizontal direction is approximately the same as that of loop frame 10, and the length thereof in the vertical direction is such that, when closed, the tip of hinging stopper 20 is disposed somewhat more toward the base end than the tip of wide insertion hole region 13*a* of loop frame 10, the length thereof being such as will cause it to just barely abut the base end side face of engagement projection 32 of tongue 30 when tongue 30 is closed, as will be described below. Hinging stopper 20 is therefore of such size and shape as to cover most of wide insertion hole region 13*a* of loop frame 10 when hinging stopper 20 is in its closed state.

Moreover, formed at the tip of hinging stopper 20 is stopper protrusion 25 which mates with capturing notch 341 formed at the base end side face of engagement projection 32 of tongue 30, described below. Furthermore, formed at either side face of hinging stopper 20 are fingernail recesses 26 which can be grasped by fingernails when hinging stopper 20 is to be opened from its closed state.

Tongue 30, which is a member that is made of synthetic resin of approximately the same size as loop frame 10, comprises flexible strip-like piece 31; engagement projection 32 which is formed on the surface facing loop frame 10 at a location near the tip of strip-like piece 31; and hinge portion 37 which is formed at the base portion of strip-like piece 31.

Engagement projection 32, which is a portion that in inserted through and engages with capturing hole 13 of loop frame 10, comprises large-diameter head portion 33 which is more or less cylindrical in shape and which is disposed toward the tip; and small-diameter neck portion 34 which is more or less cylindrical in shape and which is disposed toward the base (toward strip-like piece 31). Head portion 33 is of such size and shape as to be capable of being inserted through wide insertion hole region 13*a* of loop frame 10 but incapable of being inserted through narrow capturing hole region 13*b*; neck portion 34 is of such size and shape as to be capable of being inserted through both wide insertion hole region 13*a* and narrow capturing hole region 13*b*.

Furthermore, at the base end side face of engagement projection 32, the portion corresponding to neck portion 34 is unconstricted, the side faces of neck portion 34 and head portion 33 lying in the same plane (see FIG. 5 (*b*) and elsewhere). Moreover, formed at the base end side face of engagement projection 32 is capturing notch 341, which is cut thereinto from head portion 33 to neck portion 34 in such fashion as to be directed toward the tip.

Hinge portion 37, which is a portion formed at the end portion at the base end of tongue 30 for the purpose of achieving coupling with respect to loop frame 10 through a hinge structure, comprises bent portion 39 which is a portion at which strip-like piece 31 is bent back upon itself; and back catch 38 which is a protrusion formed at the end portion at the base end.

When loop frame 10 and hinging stopper 20 and tongue 30 are to be coupled together, hinge portion 37 is inserted through hinge hole 15*a* of loop frame 10, and is moreover inserted through hinge hole 21 of hinging stopper 20, following which back catch 38 at the end portion is then inserted through hinge hole 15*b*. As a result of doing this, back catch 38 is made to snag on features including lateral slat 12 of loop frame 10, causing hinge portion 37 to be captured in such fashion that it is unable to come free of loop frame 10.

This causes hinge portion 37 at the base portion of tongue 30 to be secured in such fashion as to revolve about hinge shaft 14 at the base portion of loop frame 10 and hinge shaft 22 at the base portion of hinging stopper 20. This causes tongue 30 to be made capable of being opened and closed with respect to loop frame 10, for which purpose a portion in the vicinity of hinge shaft 14 at bent portion 39 serves as the hinge shaft (rotary shaft) about which opening and closing of the tongue occurs.

Furthermore, the fact that hinge shaft 22 of hinging stopper 20 is, together with hinge shaft 14 of loop frame 10, wrapped about by bent portion 39 of tongue 30 causes it to be sandwiched between hinge shaft 14 of loop frame 10 and bent portion 39 of tongue 30. As a result of rotation of hinge shaft 22, which is the shaft about which opening and closing of the stopper occurs, in the space produced by this sandwiching, hinging stopper 20 is made capable of being opened and closed with respect to loop frame 10.

Thus, in the embodiment shown in FIGS. 1 and 2, tongue 30 is coupled in hinged fashion by a hinge (which may be a living hinge) structure to loop frame 10, and hinging stopper 20 is also coupled in hinged fashion by a hinge structure to loop frame 10.

Loop frame 10 and tongue 30, which are coupled together by a living hinge or other such hinge structure, are such that causing engagement projection 32 of tongue 30 to be inserted into and captured by capturing hole 13 of loop frame 10 permits tongue 30 to be secured in a closed state with respect to loop frame 10. Causing an edge of an opening at a top end of a garter stocking to be clamped between loop frame 10 and tongue 30 before this is closed will make it possible for the edge of the garter stocking 7 to be fastened by garter clip 1 (see FIG. 6).

When engagement projection 32 is inserted into capturing hole 13, engagement projection 32 is moved toward the base end as tongue 30 is bent, and head portion 33 is inserted in inclined fashion into wide insertion hole region 13*a* of loop frame 10. At this time, in accordance with the present embodiment, because hinging stopper 20 is openable/closable with respect to loop frame 10, when engagement projection 32 is to be inserted into capturing hole 13, causing hinging stopper 20 to be in its open state will facilitate insertion of head portion 33 into wide insertion hole region 13*a*.

Whereas head portion 33 cannot after being inserted into wide insertion hole region 13*a* encroach upon the interior of narrow capturing hole region 13*b*, if insertion proceeds to the point where neck portion 34 is inserted into wide insertion hole region 13*a* it will be possible for neck portion 34 to encroach upon the interior of narrow capturing hole region 13*b*.

At this time, head portion 33 passes through capturing hole 13 and emerges from the opposite side of loop frame 10. With neck portion 34 disposed within narrow capturing hole region 13*b*, by causing engagement projection 32 to slide toward the tip end of loop frame 10, it will therefore be possible to cause engagement projection 32 to move to a location in the vicinity of the tip of narrow capturing hole region 13*b*.

If engagement projection 32 moves to the point where it is at a location in the vicinity of the tip of narrow capturing hole region 13*b*, because the portion of loop periphery 11 which is peripheral to narrow capturing hole region 13*b* will be sandwiched between head portion 33 and strip-like piece 31, engagement projection 32 will only be permitted to move in the sliding direction (long direction), and will be prevented from coming free of capturing hole 13 so long as it does not move to the point where it reaches wide insertion hole region 13*a*.

On the other hand, if garter clip 1, at which this is captured in such fashion when in its closed state, is now opened and engagement projection 32 is made to slide to a point where it reaches wide insertion hole region 13*a*, it will be possible for head portion 33 to come free therefrom after it has passed through capturing hole 13. This makes it possible for this to be released from its captured state and for garter clip 1 to be opened.

Moreover, as shown in FIG. 2, after engagement projection 32 has been inserted into capturing hole 13 such that it is captured by narrow capturing hole region 13*b*, and tongue 30 has been made to be in a closed state with respect to loop frame 10, if hinging stopper 20 is closed in such fashion that it overlaps loop frame 10, hinging stopper 20 will be in a state in which it covers most of wide insertion hole region 13*a* of capturing hole 13 of loop frame 10.

For this reason, even if engagement projection 32 of tongue 30, which is disposed within narrow capturing hole region 13*b* when this is in its closed state, were to attempt to move toward wide insertion hole region 13*a*, this would collide with and be prevented from moving by the tip of hinging stopper 20 against which head portion 33 has been closed.

When hinging stopper 20 is in its closed state, stopper protrusion 25 at the tip thereof mates with capturing notch 341 formed at the base end side face of engagement projection 32 of tongue 30, pressing engagement projection 32 toward the tip end. Hinging stopper 20, once it has been closed, therefore cannot easily be opened by causing it to pivot about the stopper hinge shaft.

In accordance with the present embodiment, by using a fingernail or the like to grasp fingernail recess 26 formed at the side face of hinging stopper 20, and by then pulling on hinging stopper 20 with considerable force in a direction such as will cause this to be opened, it is possible to cause hinging stopper 20 when closed to become opened.

In this way, hinging stopper 20 when in its closed state functions as a stopper to constrain engagement projection 32 of tongue 30 so as to prevent it from moving toward the base end; and when hinging stopper 20 is in its closed state, as engagement projection 32 cannot be made to come free of capturing hole 13, tongue 30 when closed cannot be made to open.

Moreover, the capturing mechanism for capturing and securing hinging stopper 20 in its closed state is not limited to the combination of capturing notch 341 formed at the base end of engagement projection 32 of tongue 30 and stopper protrusion 25 at the tip of hinging stopper 20 that has been described above, it being possible to employ other capturing mechanism(s) as appropriate.

For example, even where capturing notch 341 of engagement projection 32 of tongue 30 and stopper protrusion 25 at the tip of hinging stopper 20 are not present, if the tip of hinging stopper 20 is constituted so as to, when closed, abut the base end side face of engagement projection 32 disposed at narrow capturing hole region 13*b* as it pushes said engagement projection 32 toward the tip end, the force of friction will prevent hinging stopper 20 from easily being opened and will permit achievement of a capturing mechanism.

Furthermore, capturing mechanism(s) might be achieved by causing catches such as will catch on loop periphery 11 of loop frame 10 to be provided near either side edge portion on the face of hinging stopper 20 which is toward loop frame 10, and/or by causing protruding portion(s) to be formed at side face(s) of loop periphery 11 of loop frame 10 and causing recessed portion(s) which will mate with said protruding portion(s) to be provided at hinging stopper 20.

Description of the constitution of garter clip 1 having been given above, a manner of using garter clip 1 will now be described with reference to FIG. 6. Garter clip 1 may be used to fasten an edge of an opening at a top end of a garter stocking worn on a leg to suspend and lift the garter stocking 7 in such fashion that it is suspended below a garter belt worn around the waist by a suspender strap 9.

At a time when garter clip 1 is to be worn, with it oriented such that tongue 30 is disposed at the inside (leg side) and loop frame 10 is disposed at the outside, an edge of an opening at a top end of garter stocking 7 is clamped onto thereby, engagement projection 32 of tongue 30 is inserted into and made to slide toward the tip end of capturing hole 13 of loop frame 10, and tongue 30 is closed.

If hinging stopper 20 is then closed, this will make it possible to inhibit engagement projection 32 so that it is prevented from sliding toward the base end, securing of which can be carried out by causing tongue 30 to be in its closed state. In accordance with the present embodiment, garter stocking 7 can therefore be secured in a tightly clamped state between loop frame 10 and tongue 30, permitting the edge of garter stocking 7 to be fastened in stable fashion such that garter clip 1 does not come off therefrom.

Furthermore, when garter clip 1 is in a state such that garter stocking 7 is fastened thereby, hinging stopper 20 when in its closed state serves as cover to cover that portion of loop frame 10 which corresponds to wide insertion hole region 13*a*.

In some embodiments, garter clip 1 might cause a garter stocking to be sandwiched in a wrinkled state between loop frame 10 and tongue 30 in such fashion that it is exposed to the exterior and plainly visible by way of wide insertion hole region 13*a* of loop frame 10. In contradistinction thereto, in other embodiments, as a result of the fact that wide insertion hole region 13*a* is covered by hinging stopper 20, it may be possible to cause the portion corresponding to garter stocking 7 that is sandwiched therebetween to be hidden in covered fashion.

Moreover, in embodiments in which hinging stopper 20 is plate-like, a logo or design can be easily printed on the front surface thereof, making it possible to provide a garter clip 1 having excellent design characteristics when worn.

Figure 7:
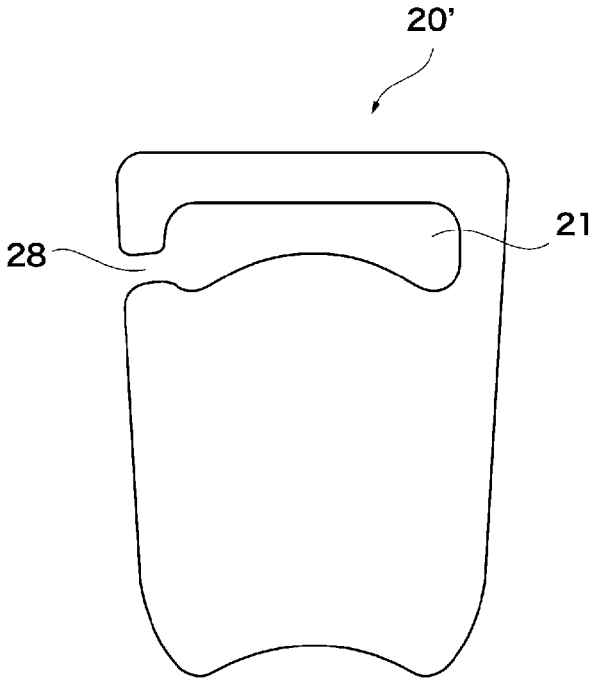
FIG. 7 is a front view of a hinging stopper associated with a first variation on the embodiment shown in FIG. 1.

Referring to FIG. 7, this shows a front view of hinging stopper 20' associated with a first variation on the embodiment shown in FIGS. 1 and 2. As the constitution of hinging stopper 20' in the present first variation differs from that of the foregoing embodiment, the present description will focus on the differences in constitution therebetween.

As compared with hinging stopper 20 associated with the foregoing embodiment, hinging stopper 20' associated with the present first variation is such that opening 28 is formed at a side portion of hinge hole 21, causing a portion of hinge hole 21 to be open to the exterior.

By thus causing a side portion of hinge hole 21 to be open, one end of hinge shaft 22 becomes a free end which is not connected to anything, and so at a time when hinging stopper 20 is to be coupled with respect to loop frame 10, it will also be possible for hinge portion 37 to be inserted into hinge hole 21 by way of the portion corresponding to opening 28 without there being any need to cause hinge portion 37 of tongue 30 to pass through hinge hole 21 by way of the tip thereof.

As described above, the present first variation provides operation and effect similar to those at the foregoing embodiment, and also makes it possible when loop frame 10 and tongue 30 are already coupled for hinging stopper 20 to thereafter be additionally coupled with respect thereto, and/or permits only hinging stopper 20 to be easily removed therefrom.

While embodiments of the present invention including variations thereon have been described above, modes of carrying out the present invention are not limited to the foregoing embodiments, a great many variations being possible without departing from the gist of the present invention. For example, the sizes, shapes, and so forth of the parts that make up the garter clip may be varied as appropriate. Furthermore, whereas in the foregoing embodiments the tongue and the loop frame were constituted as separate entities from separate materials, these may be formed in integral fashion from the same synthetic resin or the like. Furthermore, the tongue may be made of cloth.

Furthermore, whereas the foregoing embodiments were described in terms of examples in which a garter stocking (tubular cloth member) worn on a leg was employed as object to be fastened by a garter clip serving as cloth member fastener, the cloth member fastener is not limited to tubular cloth members having openings but may be used to fasten edges of a wide variety of cloth members.

For example, a cloth member fastener associated with the present invention may also be employed to fasten an edge of an opening of a diaper-like penis retainer which is a tubular cloth member disclosed by the present inventor at Japanese Patent Application Publication Kokai No. 2010-154994.

Furthermore, the shape of hinging stopper 20 may be varied as appropriate, it being possible to add hole(s) thereto so as to permit it to function as a figure-eight slide for fastening of a lateral strap, and/or instead of being plate-like it may be made to have a three-dimensional shape such as will permit it to cover the head of the tongue.

EXPLANATION OF REFERENCE NUMERALS

1 Garter clip
10 Loop frame
11 Loop periphery
12 Lateral slat
13 Capturing hole
14 Hinge shaft
15 Hinge hole
20 Hinging stopper
21 Hinge hole
22 Hinge shaft
25 Stopper protrusion
26 Fingernail recess
30 Tongue
31 Strip-like piece
32 Engagement projection
33 Head portion
34 Neck portion
341 Capturing notch
37 Hinge portion
38 Back catch
39 Bent portion
7 Garter stocking
9 Suspender strap

What is claimed is:

1. A cloth member fastener for clamping and holding an edge of a cloth member, the cloth member fastener comprising:

a tongue;

a loop frame; and a hinging stopper;

wherein the tongue, the loop frame, and the hinging stopper are mutually coupled in hinged fashion by means of a common hinge structure;

wherein the tongue comprises an engagement projection which is captured by the loop frame and which has a head portion and a neck portion;

wherein the tongue further comprises a bent portion which is a part that is bent back upon itself toward a base end of the tongue;

wherein the tongue further comprises a back catch which is formed at an end portion at the base end of the tongue;

wherein the loop frame comprises a capturing hole for capturing the engagement projection when the engagement projection is inserted therein;

wherein the capturing hole of the loop frame comprises a narrow capturing hole region which is disposed at a location toward the tip end of the loop frame and through which only the neck portion can pass; and a wide insertion hole region which is disposed at a location toward the base end of the loop frame and through which the head portion and the neck portion can pass;

wherein the narrow capturing hole region and the wide insertion hole region are formed so as to be joined in continuous fashion in a long direction perpendicular to a tongue hinge shaft at the hinge structure;

wherein the loop frame further comprises two hinge holes formed at a base portion of the loop frame;

wherein the two hinge holes of the loop frame cause the tongue to be coupled in hinged fashion with respect to the loop frame by virtue of the fact that the bent portion of the tongue is made to pass through the two hinge holes of the loop frame in continuous fashion;

wherein a hinge shaft of the hinging stopper extends in a horizontal direction and is disposed toward the base end of the hinging stopper; and wherein the hinging stopper is coupled in hinged fashion by the means of the hinge structure with respect to the loop frame as a result of the fact that the stopper hinge shaft is wrapped about between the two hinge holes of the loop frame by the bent portion of the tongue.

2. The cloth member fastener according to claim 1 wherein the hinging stopper is constituted so as to cover the wide insertion hole region of the capturing hole when the hinging stopper is in a closed state with respect to the loop frame.

3. The cloth member fastener according to claim 2 wherein the hinging stopper is constituted such that, when the hinging stopper is closed with respect to the loop frame, the hinging stopper inhibits the engagement projection of the tongue so as to prevent the engagement projection of the tongue, when the engagement projection of the tongue is captured by the loop frame at the narrow capturing hole region, from moving toward the wide insertion hole region.

4. The cloth member fastener according to claim 3 wherein the hinging stopper further comprises a hinge hole which extends in the horizontal direction and through which the hinge portion of the tongue is inserted.

5. The cloth member fastener according to claim 4 wherein the hinge hole of the hinging stopper is a closed figure that is not open to the exterior.

6. The cloth member fastener according to claim 4 wherein the hinge hole of the hinging stopper is an open figure, an opening to the exterior being formed at a side portion of the hinge hole of the hinging stopper.

7. The cloth member fastener according to claim 1 wherein formed at either side face of the hinging stopper are fingernail recesses which can be grasped by fingernails when the hinging stopper is to be opened from its closed state.

8. The cloth member fastener according to claim 1 further comprising a capturing mechanism for capturing and securing the hinging stopper in a closed state with respect to the loop frame;

wherein the capturing mechanism is constituted such that, when the hinging stopper is in its closed state, a tip of the hinging stopper abuts a base end side face of the engagement projection of the tongue as the tip of the hinging stopper pushes said engagement projection toward the tip end when the engagement projection of the tongue is disposed at the narrow capturing hole region of the loop frame.

9. The cloth member fastener according to claim 8 wherein the capturing mechanism comprises:

a stopper protrusion which is provided at the tip of the hinging stopper; and a capturing notch which is provided at the base end side face of the engagement projection of the tongue and which mates with the stopper protrusion.

10. The cloth member fastener according to claim 1 wherein the common hinge structure comprises:

a hinge shaft of the loop frame;

the hinge shaft of the hinging stopper; and a hinge portion of the tongue that at least partially surrounds and captures therewithin the hinge shaft of the loop frame and the hinge shaft of the hinging stopper.

11. The cloth member fastener according to claim 10 wherein the tongue hinge portion of the tongue is formed as a result of the fact that the base end of the tongue is bent back upon itself.

* * * * *